United States Patent [19]

Hörnig

[11] 4,311,604

[45] Jan. 19, 1982

[54] SOAP BAR AND PROCESS FOR ITS MANUFACTURE

[75] Inventor: Hans W. Hörnig, Horb, Fed. Rep. of Germany

[73] Assignee: Blendax-Werke R. Schneider GmbH & Co., Mainz, Fed. Rep. of Germany

[21] Appl. No.: 212,150

[22] Filed: Dec. 2, 1980

Related U.S. Application Data

[63] Continuation of Ser. No. 49,093, Jun. 18, 1979, abandoned.

[30] Foreign Application Priority Data

Mar. 15, 1979 [DE] Fed. Rep. of Germany ..... 2910106

[51] Int. Cl.[3] ..... C11D 13/08; C11D 13/14; C11D 13/28; C11D 17/04

[52] U.S. Cl. ..... 252/90; 252/92; 252/134; 252/174; 252/DIG. 16

[58] Field of Search ..... 252/90, 92, 134, 174, 252/DIG. 16

[56] References Cited

U.S. PATENT DOCUMENTS

| | | | |
|---|---|---|---|
| 710,939 | 10/1902 | Berry | 252/90 |
| 1,267,949 | 5/1918 | Williams | 252/90 |
| 1,441,315 | 1/1923 | Walbridge | 252/90 |
| 1,764,009 | 6/1930 | Embree | 252/134 |
| 2,271,959 | 2/1942 | Swanson | 252/134 |
| 2,292,359 | 8/1942 | Block | 252/90 |
| 2,423,435 | 7/1947 | Block | 252/90 |
| 3,729,421 | 4/1973 | Gibson | 252/134 |

FOREIGN PATENT DOCUMENTS

| | | | |
|---|---|---|---|
| 2796 | of 1888 | United Kingdom | 252/134 |
| 574291 | 12/1945 | United Kingdom | 252/134 |

*Primary Examiner*—Dennis L. Albrecht
*Attorney, Agent, or Firm*—Connolly and Hutz

[57] ABSTRACT

A new soap bar is disclosed wherein a soap bar comprises a soap bar body having a cavity stamped therein and a raised design or character imprinted in the bottom of the cavity. A smaller piece of soap of another color is used to fill the cavity whereby the imprinted design or character become visible after the mass of soap above the imprint is washed away.

8 Claims, 1 Drawing Figure

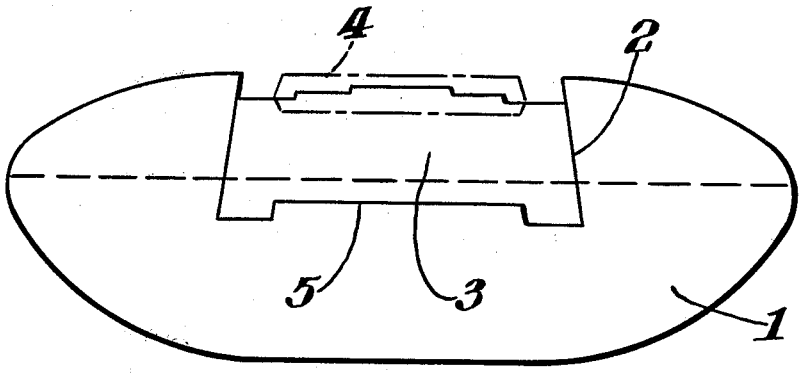
4
2
5
3
1

SOAP BAR AND PROCESS FOR ITS MANUFACTURE

This application is a continuation of application Ser. No. 049,093 filed June 18, 1979 abandoned.

BACKGROUND OF THE INVENTION

Many soap bars with various appearances have been developed which, as a rule, depend upon various optical effects. Those soap bars enjoy a great popularity with the consumer. It has been known for quite some time that one can manufacture transparent soap bars. Marbled or striped soaps have also been on the market for a long time. A particularly esthetically appealing soap consists of two equally sized halves which are colored differently. Manufacture of such soap is the subject matter of German Auslegeschrift No. 2,049,268.

Soaps are also known which contain a smaller piece of soap which is embedded in a base body of soap. The smaller piece usually has a color which contrasts with the color of the base body. Such soaps and their manufacture are described in German Offenlegungschriften Nos. 1,617,253 and 1,617,254.

A disadvantage of soaps in general and especially of the above described "inlaid soaps" is the fact that the additional characters, emblems or other marks imprinted on the surface of such soaps, which serve for the differentiation and embellishment of the optical make-up of the soap, are quickly removed by wear. Thus due to wear of a partially used soap bar, it is no longer possible for the user to determine which brand has been used.

BRIEF DESCRIPTION OF THE INVENTION

The present invention relates to a new type of soap bar and to a particularly suited process for manufacturing the soap bar.

It has been discovered that one can overcome the prior disadvantages in soaps whereby one may recognize such applied characters, emblems, marks, and so forth, during practically the entire useful life of the soap bar and especially at the end of their usage.

This objective is met by a soap bar which consists of a soap bar body of customary composition and of at least one smaller piece of soap embedded into its surface in a cavity having a relief design at the bottom of the cavity. The cavity then serves to take up the smaller embedded piece of soap which itself may have imprinted on its surface a similar relief design in the form of a character, emblem, heraldic figure or other mark.

As a result of the construction of the inventive soap, it is possible to maintain the imprinted mark visible throughout the usage period of the soap bar even when the initial imprinted mark on the surface of the soap (e.g., on the smaller inset piece of soap) has already been washed off. It is also possible to mark this mark visible again in the almost washed away soap bar.

The subject matter of the present invention further comprises a process for manufacturing a soap bar according to the invention. The process comprises manufacturing a soap bar in a known manner, stamping out a cavity therein and providing at the bottom of the cavity an imprint, preferably having a raised design. Subsequently, a smaller, preshaped piece of soap is inserted in the cavity of the soap body provided for the purpose.

The insertion of the smaller piece of soap into the cavity of the base soap body can be optimally achieved if the smaller piece of soap to be imbedded as well as the cavity of the base soap body are shaped as a cone or section of a cone.

DETAILED DESCRIPTION

The FIGURE illustrates a soap bar structured according to the present invention.

In cavity 2 stamped into the surface of soap bar body 1, a smaller piece of soap 3 is embedded. Smaller soap piece 3 has a color different from that of soap bar body 1. The embedded piece of soap 3 is provided with a raised character 4 on its surface. At the bottom of cavity 2 there is likewise, a smaller raised character 5 which is imprinted prior to imbedding the smaller piece of soap therein. Raised character 5 becomes visible to the user after the above situated soap mass has been washed away.

The soap masses for the soap bar body and for the smaller piece of soap to be imbedded therein may be manufactured separately such as by extrusion with extruders which are arranged in parallel next to one another. Both of the parallel soap ropes coming out of the extruders are cut into unfinished pieces of suitable size. Then the cavity is stamped into the soap body corresponding in size to the formed smaller pieces of soap. The bottom of the cavity is then imprinted with a relief design which may be, for example, a raised character. The formed smaller pieces of soap are inserted into the soap body cavity. The soap bar thus manufactured is stamped and if need be, is provided with an additional imprint.

The soap bodies can have any suitable shape (e.g. round or oval) and the embedded smaller piece of soap can likewise have any desired shape.

The chemical composition of the inventive soap bars is in accordance with that customarily used for soap bars. As used herein, the term "soap" is understood to include alkali salts of higher fatty acids as well as the so-called surface active soaps which contain the usual additives. In this regard, reference is made to the data in Ullmann's *Enzyklopadie der technischen Chemie,* 3rd edition, volume 18, pages 355–395 (1967, Urban & Schwarzenberg, Muchich, Berlin, Vienna) and to the monograph of D. Osteroth, "Kosmeticum Feinseife" (1972, Hüthig-Verlag, Heidelberg).

It has been found especially useful to shape the bottom of the embedded smaller piece of soap as a cavity corresponding to the raised relief design of the cavity bottom of the soap bar, i.e. as "negative mold" of said raised relief. This improves the firmness of both pieces and prevents damage of said raised relief design during stamping of the finished soap bar.

I claim:

1. In a soap bar consisting of a soap bar body and at least one smaller piece of soap embedded in a corresponding cavity in at least one surface of the body, the improvement comprises providing a raised relief design at the bottom of the soap bar body cavity to which said smaller piece is embedded, said smaller piece having a shape which corresponds to and compliments said soap bar cavity whereby the cavity is substantially filled by said small piece, wherein the outer surface of the smaller piece of soap embedded in the soap bar body has the same raised relief design as provided in the bottom of the soap bar body cavity and wherein the soap bar body and the embedded smaller piece of soap are of different colors.

2. The soap bar according to claim 1 wherein the smaller piece of soap is in the shape of a section of a cone.

3. The soap bar according to claim 1 wherein the relief design in said cavity bottom is imprinted therein and has sufficiently raised detail whereby the design becomes visible after the mass of soap above the design is washed away.

4. The process for manufacturing the soap bar according to claim 1 comprising forming a soap bar, stamping at least one cavity into said bar, imprinting a relief design into the bottom of said cavity, and filling said cavity with soap.

5. The process according to claim 4 wherein said cavity is filled by inserting a preformed piece of soap into the cavity.

6. The process according to claim 4 whereby the soap bar and the soap filling said cavity are of different colors.

7. The process according to claim 4 wherein the design at the bottom of said cavity is a raised design and the outer surface of the soap filling of the cavity has the same design imprinted therein.

8. The soap bar according to claim 1, wherein the bottom of the embedded smaller piece of soap is shaped as a cavity corresponding to the raised relief design of said cavity bottom of the soap bar.

* * * * *